US012000400B2

(12) United States Patent
Isome et al.

(10) Patent No.: US 12,000,400 B2
(45) Date of Patent: Jun. 4, 2024

(54) COMPRESSOR

(71) Applicant: DAIKIN INDUSTRIES, LTD., Osaka (JP)

(72) Inventors: Yuka Isome, Osaka (JP); Ryouhei Deguchi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/841,039

(22) Filed: Jun. 15, 2022

(65) Prior Publication Data

US 2022/0307504 A1 Sep. 29, 2022

Related U.S. Application Data

(63) Continuation of application No. PCT/JP2020/042817, filed on Nov. 17, 2020.

(30) Foreign Application Priority Data

Dec. 17, 2019 (JP) ..... 2019-227410

(51) Int. Cl.
*F04C 29/00* (2006.01)
*F04C 18/02* (2006.01)

(52) U.S. Cl.
CPC ..... *F04C 29/0021* (2013.01); *F04C 18/0215* (2013.01); *F04C 29/0042* (2013.01)

(58) Field of Classification Search
CPC ..... F04C 15/0215; F04C 29/0042; F04C 29/0021
See application file for complete search history.

(56) References Cited

U.S. PATENT DOCUMENTS 7,393,191 B2 * 7/2008 Morozumi ..... F04C 18/0215 418/101
2003/0086798 A1 * 5/2003 Tani ..... F04C 29/026 417/366

(Continued)

FOREIGN PATENT DOCUMENTS

CN 1417474 A 5/2003
JP 2004-278374 A 10/2004

(Continued)

OTHER PUBLICATIONS

International Search Report of corresponding PCT Application No. PCT/JP2020/042817 dated Dec. 22, 2020.

(Continued)

*Primary Examiner* — Connor J Tremarche
(74) *Attorney, Agent, or Firm* — Global IP Counselors, LLP

(57) ABSTRACT

A compressor includes a casing, an electric motor housed in an internal space of the casing, a drive shaft rotated by the electric motor, and a compression mechanism driven by the drive shaft discharge compressed refrigerant to the internal space. The internal space includes a first and second spaces formed near axial ends of the electric motor. The electric motor includes a stator and a rotating member. The stator is fixed to the casing. The rotating member includes a rotor rotatably inserted into the stator. The electric motor has a refrigerant flow path through which the first and second spaces communicate with each other. The refrigerant flow path includes a first flow path into which the refrigerant in the first space or the second space flows, and a rotor flow path extending axially across the rotor and connected to an outflow end of the first flow path.

3 Claims, 10 Drawing Sheets

(56) References Cited

U.S. PATENT DOCUMENTS

| | | | | |
|---|---|---|---|---|
| 2004/0179967 | A1 | 9/2004 | Morozumi et al. | |
| 2008/0038133 | A1 | 2/2008 | Sawai et al. | |
| 2012/0086291 | A1* | 4/2012 | DeBlock ..... | H02K 1/32 310/60 A |
| 2015/0052936 | A1 | 2/2015 | Yokoyama et al. | |
| 2017/0089624 | A1 | 3/2017 | Yokoyama et al. | |
| 2019/0190337 | A1 | 6/2019 | Shono et al. | |

FOREIGN PATENT DOCUMENTS

| | | | | |
|---|---|---|---|---|
| JP | 2005-147078 | A | | 6/2005 |
| JP | 2007-292023 | A | | 11/2007 |
| JP | 2010-261393 | A | | 11/2010 |
| JP | 2010261393 | A | * | 11/2010 |
| WO | 2018/061768 | A1 | | 4/2018 |

OTHER PUBLICATIONS

International Preliminary Report of corresponding PCT Application No. PCT/JP2020/042817 dated Jun. 30, 2022.
European Search Report of corresponding EP Application No. 20 90 1532.0 dated Nov. 28, 2022.

* cited by examiner

COMPRESSOR

CROSS-REFERENCE TO RELATED APPLICATIONS

This is a continuation of International Application No. PCT/JP2020/042817 filed on Nov. 17, 2020, which claims priority to Japanese Patent Application No. 2019-227410, filed on Dec. 17, 2019. The entire disclosures of these applications are incorporated by reference herein.

BACKGROUND

Technical Field

The present disclosure relates to a compressor.

Background Art

A compressor for use in a refrigeration apparatus, such as an air conditioner, has been known in the art. Japanese Unexamined Patent Publication No. 2005-147078 discloses a vertical hermetic compressor. This compressor includes a closed container (casing), and a mechanism (compression mechanism) and a motor (electric motor) that are housed in the closed container. The motor includes a stator and a rotor. Balance weights are attached to the upper and lower ends of the rotor. The rotor has a plurality of through holes (refrigerant flow paths) through each of which spaces above and below the motor communicate with each other. A refrigerant discharged from the mechanism is introduced to the inner surface of an upper one of the balance weights, and passes through the through holes of the rotor so as to be released into the space below the motor.

SUMMARY

A first aspect of the present disclosure is directed to a compressor. The compressor includes a casing, an electric motor housed in an internal space of the casing, a drive shaft rotated by the electric motor, and a compression mechanism driven by the drive shaft to compress a refrigerant and discharge the compressed refrigerant to the internal space. The internal space includes a first space formed near one axial end of the electric motor, and a second space formed near another axial end of the electric motor. The electric motor includes a stator and a rotating member. The stator is fixed to the casing. The rotating member includes a rotor rotatably inserted into the stator. The electric motor has a refrigerant flow path through which the first and second spaces communicate with each other. The refrigerant flow path includes a first flow path into which the refrigerant in the first space or the second space flows, and a rotor flow path extending axially across the rotor and connected to an outflow end of the first flow path. The first flow path includes a second flow path extending from the rotor flow path toward an outer periphery of the rotor.

DETAILED DESCRIPTION OF EMBODIMENT(S)

First Embodiment

A first embodiment will be described.

Scroll Compressor

Figure 1:
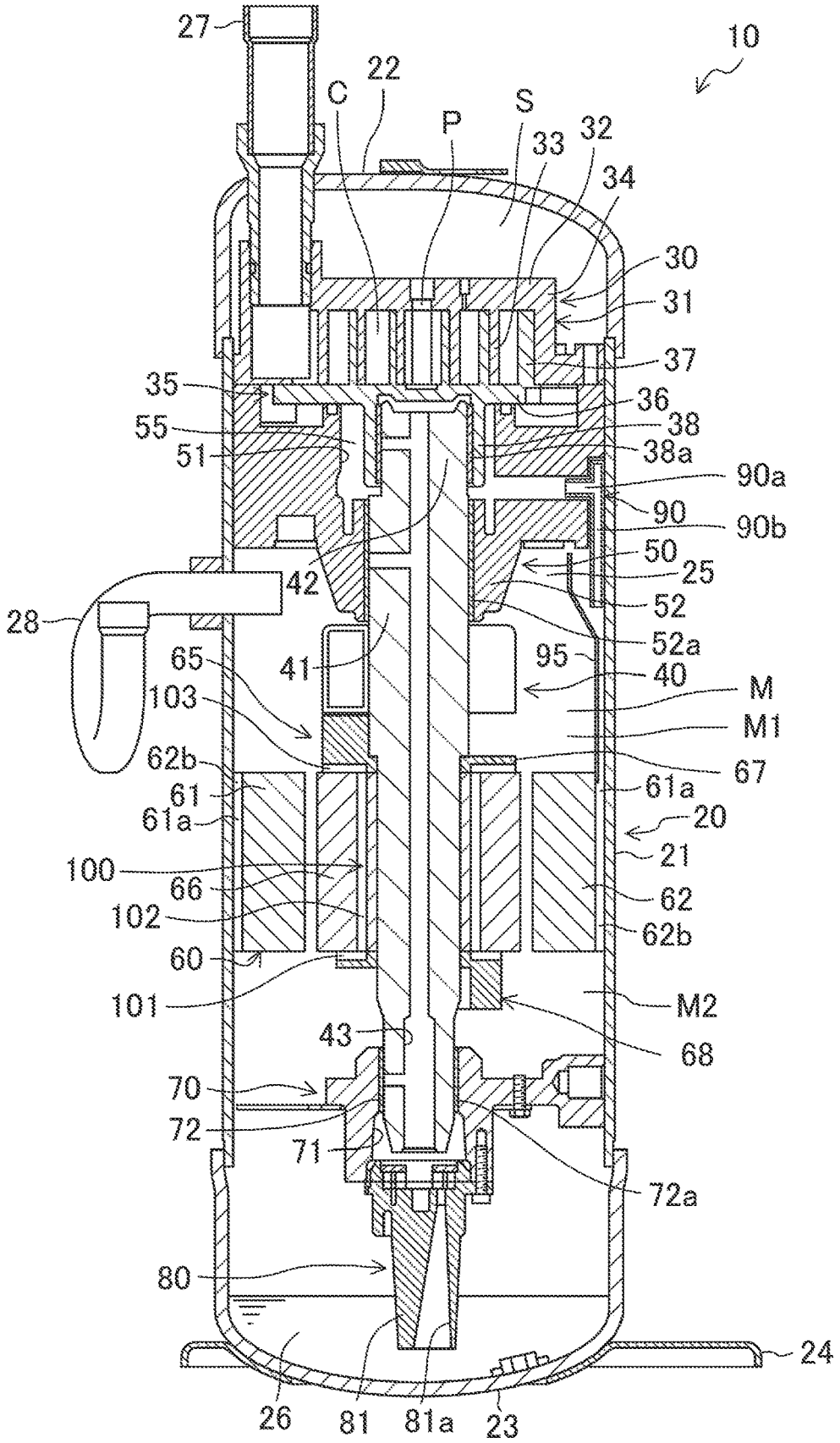
FIG. 1 is a vertical sectional view illustrating a configuration of a scroll compressor according to a first embodiment.

As illustrated in FIG. 1, a compressor (10) is a scroll compressor. The scroll compressor (10) is connected to, for example, a refrigerant circuit of an air conditioner. This refrigerant circuit performs a vapor compression refrigeration cycle. The refrigerant circuit is a closed circuit including a compressor, a condenser (radiator), a decompression mechanism, and an evaporator, which are connected together in this order. In the refrigerant circuit, a refrigerant (a fluid) compressed by the compressor (10) dissipates heat in the condenser, and is decompressed by the decompression mechanism. Then, the decompressed refrigerant evaporates in the evaporator, and is sucked into the compressor (10).

The compressor (10) includes a casing (20), a compression mechanism (30), a drive shaft (40), a housing (50), an electric motor (60), a lower bearing member (70), and an oil pump (80). Inside the casing (20), the compression mechanism (30), the housing (50), the electric motor (60), the lower bearing member (70), and the oil pump (80) are arranged in this order from the top to the bottom.

Casing

The casing (20) is configured as a vertically long cylindrical closed container. A vertically long internal space (M) is formed in the casing (20). The casing (20) includes a barrel (21), a first end plate (22), a second end plate (23), and a leg (24). The barrel (21) is in the shape of a cylinder with both axial (upper and lower) ends open. The first end plate (22) closes one axial end (upper end) of the barrel (21). The second end plate (23) closes the other axial end (lower end) of the barrel (21). The leg (24) is provided on the lower side of the second end plate (23) to support the casing (20).

The casing (20) is connected to a suction pipe (27) and a discharge pipe (28). The suction pipe (27) axially penetrates the first end plate (22) of the casing (20), and communicates with a compression chamber (C) of the compression mechanism (30). The discharge pipe (28) has an inner end that opens in a space above the electric motor (60) in the casing (20). The discharge pipe (28) radially penetrates the barrel (21) of the casing (20), and communicates with a space (25) below the housing (50) (more specifically, a space between the housing (50) and the electric motor (60)).

An oil reservoir (26) is provided at the bottom of the casing (20). The oil reservoir (26) stores lubricant (herein-after referred to also as the "oil") for lubricating sliding components inside the compressor (10).

Compression Mechanism

The compression mechanism (30) sucks, and compresses, a fluid (in this embodiment, a refrigerant), and discharges the compressed fluid into a discharge chamber (S). The compression mechanism (30) is driven by the electric motor (60) via the drive shaft (40). The compression mechanism (30) is provided in the internal space (M) of the casing (20). The compression mechanism (30) includes a fixed scroll (31), and an orbiting scroll (35) meshing with the fixed scroll (31).

Fixed Scroll

The fixed scroll (31) includes a fixed end plate portion (32), a fixed wrap (33), and an outer peripheral wall portion (34). The fixed end plate portion (32) is in the shape of a disk. The fixed wrap (33) is in the shape of a spiral wall that draws an involute curve, and protrudes from the front surface (lower surface) of the fixed end plate portion (32). The outer peripheral wall portion (34) surrounds the outer peripheral side of the fixed wrap (33), and protrudes from the front surface (lower surface) of the fixed end plate portion (32). The distal end surface (lower surface) of the outer peripheral wall portion (34) is substantially flush with the distal end surface of the fixed wrap (33).

Orbiting Scroll

The orbiting scroll (35) includes an orbiting end plate portion (36), an orbiting wrap (37), and a boss portion (38). The orbiting end plate portion (36) is in the shape of a disk. The orbiting wrap (37) is in the shape of a spiral wall that draws an involute curve, and protrudes from the front surface (upper surface) of the orbiting end plate portion (36). The boss portion (38) is in the shape of a cylinder, and is disposed on a central portion of the back surface (lower surface) of the orbiting end plate portion (36). A first sliding bearing (38*a*) is fitted to the inner surface of the boss portion (38).

Compression Chamber, Discharge Port, Discharge Chamber

In the compression mechanism (30), the orbiting wrap (37) of the orbiting scroll (35) is meshed with the fixed wrap (33) of the fixed scroll (31). This forms a compression chamber (the compression chamber (C) where a fluid is to be compressed) surrounded by the fixed end plate portion (32) and fixed wrap (33) of the fixed scroll (31) and the orbiting end plate portion (36) and orbiting wrap (37) of the orbiting scroll (35).

The fixed end plate portion (32) of the fixed scroll (31) has a discharge port (P). The discharge port (P) axially penetrates a central portion of the fixed end plate portion (32) to communicate with the compression chamber (C). A space between the fixed scroll (31) and the first end plate (22) of the casing (20) forms a discharge chamber (S), which communicates with the discharge port (P). The discharge chamber (S) communicates with the space (25) below the housing (50) through a discharge passage (not shown) formed in the fixed scroll (31) and the housing (50). According to the above configuration, the space (25) below the housing (50) constitutes a high-pressure space that is filled with a high-pressure fluid (e.g., a high-pressure discharged refrigerant).

Drive Shaft

The drive shaft (40) extends inside the casing (20) in a top-to-bottom direction. Specifically, the drive shaft (40) extends in the axial direction (top-to-bottom direction) of the casing (20) from the upper end of the barrel (21) of the casing (20) to the bottom (oil reservoir (26)) of the casing (20). The drive shaft (40) is rotated by the electric motor (60), which will be described below.

In this example, the drive shaft (40) has a main shaft portion (41) and an eccentric shaft portion (42). The main shaft portion (41) extends in the axial direction (top-to-bottom direction) of the casing (20). The eccentric shaft portion (42) is provided at the upper end of the main shaft portion (41). The eccentric shaft portion (42) has a smaller outside diameter than the main shaft portion (41) does, and has its axial center decentered by a predetermined distance with respect to the axial center of the main shaft portion (41).

The drive shaft (40) has its upper end portion (i.e., its eccentric shaft portion (42)) slidably connected to the boss portion (38) of the orbiting scroll (35). In this example, the eccentric shaft portion (42) of the drive shaft (40) is rotatably supported by the boss portion (38) of the orbiting scroll (35) with the first sliding bearing (38*a*) interposed therebetween. The drive shaft (40) has therein an oil supply channel (43) extending axially (in the top-to-bottom direction).

Housing

The housing (50) is in the shape of a cylinder extending in the axial direction (top-to-bottom direction) of the casing (20), and is provided below the orbiting scroll (35) inside the casing (20). The drive shaft (40) is inserted into, and runs through, the housing (50). An upper portion of the housing (50) has a larger outside diameter than a lower portion thereof does, and has an outer peripheral surface fixed to the inner peripheral surface of the barrel (21) of the casing (20).

An upper portion of the housing (50) has a larger inside diameter than a lower portion thereof does. The upper portion of the housing (50) houses therein the boss portion (38) of the orbiting scroll (35). The inner surface of the lower portion of the housing (50) rotatably supports the main shaft portion (41) of the drive shaft (40).

The upper portion of the housing (50) has a recess (51) recessed downward. The recess (51) forms a crank chamber (55) that houses the boss portion (38) of the orbiting scroll (35). The lower portion of the housing (50) forms a main bearing portion (52) that axially penetrates the housing (50) to communicate with the crank chamber (55). The main bearing portion (52) rotatably supports the main shaft portion (41) of the drive shaft (40).

A second sliding bearing (52*a*) is fitted to the inner surface of the main bearing portion (52), which rotatably supports the main shaft portion (41) of the drive shaft (40) with this second sliding bearing (52*a*) interposed therebetween.

Electric Motor

The electric motor (60) drives the compression mechanism (30) via the drive shaft (40). The electric motor (60) is housed in the internal space (M) of the casing (20), and is provided below the compression mechanism (30). Specifically, the electric motor (60) is provided below the housing (50) inside the casing (20).

The outer peripheral surface of the electric motor (60) is fixed to the inner peripheral surface of the barrel (21) of the casing (20). In this manner, the internal space (M) of the casing (20) is partitioned into an upper space (M1) (a first space) above the electric motor (60) (near one axial end) and a lower space (M2) (a second space) below the electric motor (60) (near the other axial end). A lower end portion of the lower space (M2) below the electric motor (60) forms the oil reservoir (26).

The electric motor (60) includes a stator (61) and a rotating member (65). The rotating member (65) includes a rotor (66) and upper and lower balance weights (67) and (68).

Stator

The stator (61) is in the shape of a cylinder. The stator (61) is fixed to the barrel (21) of the casing (20). The stator (61)

is arranged coaxially with the drive shaft (40). The stator (61) surrounds the rotor (66). The stator (61) includes a core (62) and a coil (not shown).

The core (62) is in the shape of a cylinder. The outer peripheral surface of the core (62) is fixed to the inner peripheral surface of the casing (20). The outer peripheral surface of the core (62) has a plurality of core cuts (62*b*).

The core cuts (62*b*) are grooves (notches) formed in the top-to-bottom direction from the upper end to the lower end of the core (62). The core cuts (62*b*) are formed at predetermined intervals along the circumferential direction of the core (62). The core cuts (62*b*) make the upper and lower spaces (M1) and (M2) above and below the electric motor (60) communicate with each other. The core cuts (62*b*) have a width that is uniform in the top-to-bottom direction.

The core cuts (62*b*) each form a gas flow path (61*a*) extending between the casing (20) and the core (62) (outside the stator (61)) in the top-to-bottom direction. The gas flow paths (61*a*) are passages each formed by the core cut (62*b*) and the inner surface of the casing (20).

A gas refrigerant discharged from the compression mechanism (30) flows down through the gas flow paths (61*a*). The gas flow paths (61*a*) guide the lubricant contained in the gas refrigerant discharged from the compression mechanism (30) to the bottom of the casing (20). The gas refrigerant passing through the gas flow paths (61*a*) cools the electric motor (60). The gas flow paths (61*a*) extend outside the core (62) from the upper end to the lower end of the core (62) in the top-to-bottom direction. The gas flow paths (61*a*) each have a width that is uniform in the top-to-bottom direction.

Rotor

The rotor (66) is in the shape of a cylinder. The rotor (66) is rotatably inserted into the stator (61). The rotor (66) is arranged coaxially with the drive shaft (40). The rotor (66) is arranged such that its axis extends in the top-to-bottom direction. The drive shaft (40) is inserted into, and runs through, the rotor (66), and is fixed to the inner surface of the rotor (66). The rotor (66) has rotor flow paths (102), which will be described below.

Balance Weight

The balance weights (67, 68) are provided to counteract the unbalance force induced by the orbiting motion of the compression mechanism (30). As illustrated in FIG. 1, the balance weights (67, 68) are fixed to both upper and lower (axial) ends of the rotor (66). The balance weights (67, 68) include an upper balance weight (67) and a lower balance weight (68).

Figure 2:
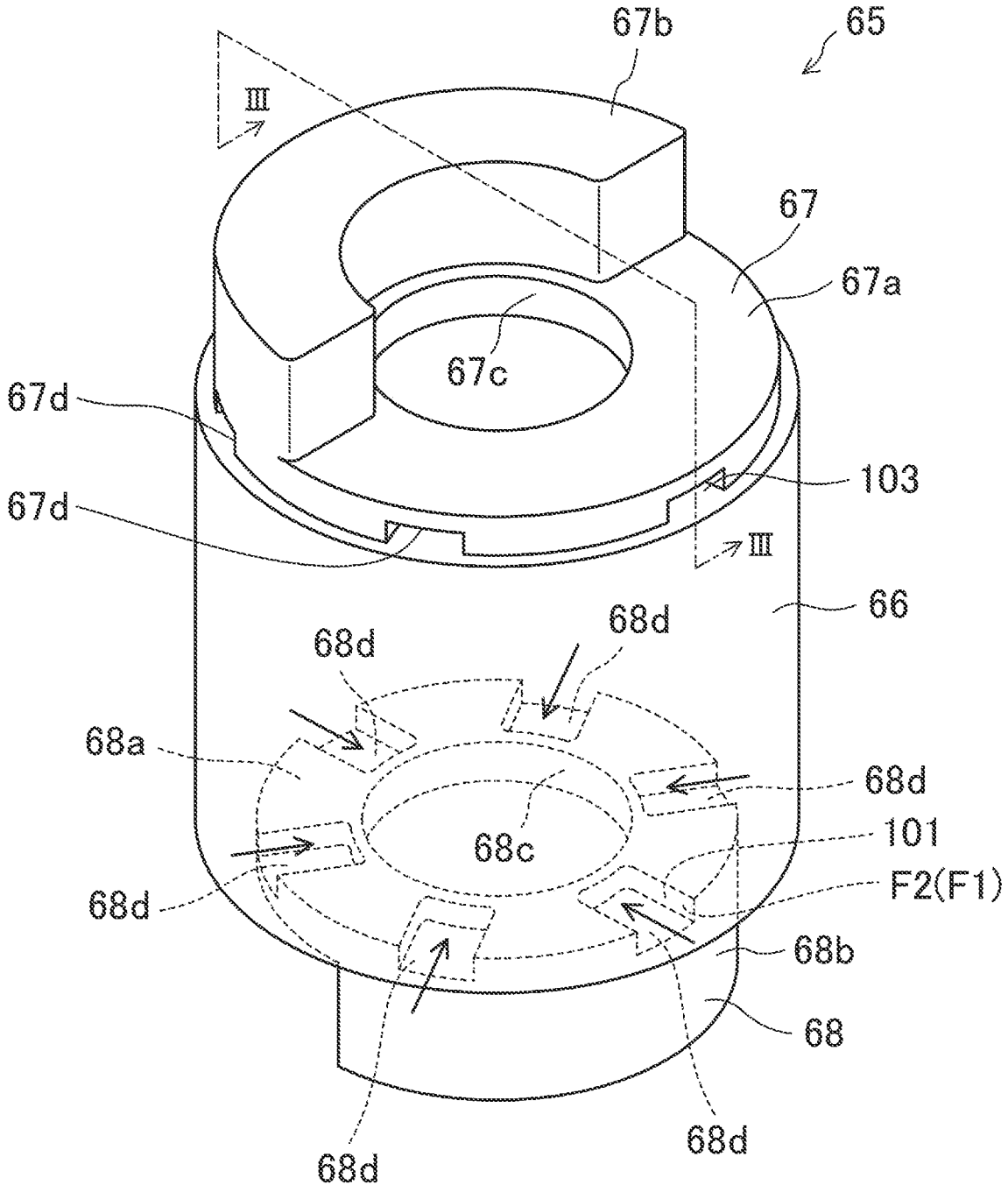
FIG. 2 is a perspective view of a rotating member.

As illustrated in FIG. 2, the upper balance weight (67) has a flat plate portion (67*a*) and a weight portion (67*b*). The flat plate portion (67*a*) is a plate-shaped portion formed in the shape of a ring. A central portion of the flat plate portion (67*a*) has a through hole (67*c*) through which the drive shaft (40) passes. The weight portion (67*b*) protrudes upward (toward one axial end) from a generally half portion of the flat plate portion (67*a*) in the circumferential direction.

Figure 3:
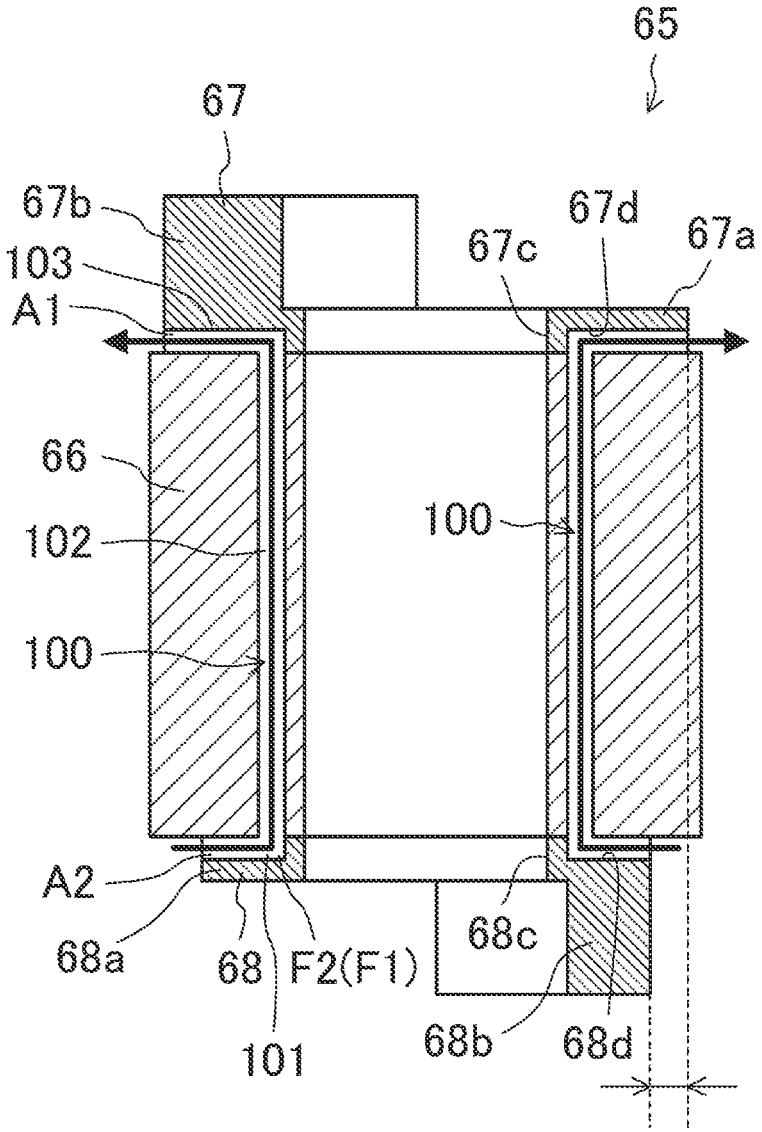
FIG. 3 is a cross-sectional view taken along line III-III in FIG. 2.

As illustrated in FIGS. 2 and 3, a surface (a lower surface) of the flat plate portion (67*a*) opposite to the surface thereof on which the weight portion (67*b*) is formed has a plurality of recesses (67*d*) extending radially outward. In this embodiment, the number of the recesses (67*d*) is six, as with the number of recesses (68*d*), which will be described below. The recesses (67*d*) are formed at predetermined intervals along the circumferential direction. Each recess (67*d*) has its radially inner end (one end) closed, and has its radially outer end (the other end) opened. The recesses (67*d*) have a width and depth that are uniform in the radial direction.

The lower balance weight (68) has a flat plate portion (68*a*) and a weight portion (68*b*), as with the upper balance weight (67). The flat plate portion (68*a*) is a plate-shaped portion formed in the shape of a ring. A central portion of the flat plate portion (68*a*) has a through hole (68*c*) through which the drive shaft (40) passes. The weight portion (68*b*) protrudes downward (toward the other axial end) from a generally half portion of the flat plate portion (68*a*) in the circumferential direction.

A surface (an upper surface) of the flat plate portion (68*a*) opposite to the surface thereof on which the weight portion (68*b*) is formed has a plurality of recesses (68*d*) extending radially outward. In this embodiment, the number of the recesses (68*d*) is six. The recesses (68*d*) are formed at predetermined intervals along the circumferential direction. Each recess (68*d*) has its radially inner end (one end) closed, and has its radially outer end (the other end) opened. The recesses (68*d*) have a width and depth that are uniform in the radial direction.

Refrigerant Flow Path

As illustrated in FIG. 3, the rotating member (65) of the electric motor (60) has refrigerant flow paths (100). The refrigerant flow paths (100) make the upper and lower spaces (M1) and (M2) above and below the electric motor (60) communicate with each other. The refrigerant flow paths (100) are passages through each of which the gas refrigerant moves between these spaces (M1, M2). The refrigerant flow paths (100) each include an inflow path (101), the rotor flow path (102), and an outflow path (103). In this embodiment, the inflow path (101), the rotor flow path (102), and the outflow path (103) are formed in this order from the bottom to the top.

The inflow paths (101) are passages through each of which the gas refrigerant in the lower space (M2) below the electric motor (60) flows into the refrigerant flow path (100). Each inflow path (101) is a second flow path (F2) extending radially outward (toward the outer periphery of the rotor (66)) from the inflow end of the rotor flow path (102). The second flow paths (F2) are formed between the recesses (68*d*) of the lower balance weight (68) and the lower end surface of the rotor (66). In other words, the second flow paths (F2) are formed in the lower balance weight (68). The second flow paths (F2) each have a second opening (A2) that opens to the lower space (M2) below the electric motor (60).

Each second opening (A2) is the inflow end of the second flow path (F2) and the inflow end of the inflow path (101). The second opening (A2) is formed in the shape of a rectangle with the long sides oriented in the circumferential direction and the short sides oriented in the top-to-bottom direction. The second opening (A2) opens toward the outer periphery of the rotor (66). Even if the lubricant accumulated in the oil reservoir (26) is splashed by the gas refrigerant present in the lower space (M2) below the electric motor (60), the splashed oil cannot flow into the rotor flow path (102) without passing through the inflow path (101) via the second opening (A2). This can reduce the flow of the oil into the refrigerant flow paths (100).

The outflow end of each second flow paths (F2) is connected to the inflow end of the rotor flow path (102). The second flow paths (F2) extend radially outward (toward the outer periphery of the rotor (66)) from the inflow ends of the rotor flow paths (102). The second flow paths (F2) have a width and height that are uniform in the radial direction. In this embodiment, the number of the second flow paths (F2) is six.

The rotor flow paths (102) are passages through each of which the gas refrigerant that has flowed from the inflow path (101) into the rotor flow path (102) is guided to the outflow path (103). In other words, each rotor flow path (102) connects the inflow path (101) and the outflow path (103) together. The rotor flow paths (102) are formed in the rotor (66). The rotor flow paths (102) penetrate the rotor (66) in the top-to-bottom direction (the axial direction). The rotor flow paths (102) are formed in portions of the electric motor (60) closer to the axis of the electric motor (60) than the gas passages (61*a*) are (the portions of the electric motor (60) located radially inward from the gas passages (61*a*)) to extend in the top-to-bottom direction.

Each rotor flow path (102) has a generally oval transverse section with the major axis oriented in the circumferential direction and the minor axis oriented in the radial direction. The transverse section of the rotor flow path (102) is uniform in the top-to-bottom direction. The rotor flow paths (102) are formed at predetermined intervals along the circumferential direction of the rotor (66). The outflow end of each rotor flow path (102) is connected to the inflow end of the outflow path (103). In this embodiment, the number of the rotor flow paths (102) is six.

The outflow paths (103) are passages through each of which the gas refrigerant that has passed through the rotor flow path (102) is guided to the upper space (M1) above the electric motor (60). The outflow paths (103) are formed between the recesses (67*d*) of the upper balance weight (67) and the upper end surface of the rotor (66). In other words, the outflow paths (103) are formed in the upper balance weight (67). The outflow paths (103) each have a first opening (A1) that opens to the upper space (M1) above the electric motor (60).

Each first opening (A1) is the outflow end of the outflow path (103). The first opening (A1) is formed in the shape of a rectangle with the long sides oriented in the circumferential direction and the short sides oriented in the top-to-bottom direction. The first opening (A1) opens toward the outer periphery of the rotor (66). The inflow end of each outflow path (103) is connected to the outflow end of the rotor flow path (102). The outflow paths (103) extend radially outward (toward the outer periphery of the rotor (66)) from the outflow ends of the rotor flow paths (102). The outflow paths (103) have a width and height that are uniform in the radial direction. In this embodiment, the number of the outflow paths (103) is six.

The first openings (A1) are located radially outward of the second openings (A2) (toward the outer periphery of the rotor (66)). In this embodiment, the second flow paths (F2) correspond to first flow paths (F1) of the present invention.

Lower Bearing Member

As illustrated in FIG. 1, the lower bearing member (70) is in the shape of a cylinder extending in the axial direction (top-to-bottom direction) of the casing (20), and is provided between the electric motor (60) and the bottom (oil reservoir (26)) of the casing (20) inside the casing (20). The drive shaft (40) is inserted into, and runs through, the lower bearing member (70). In this example, the outer peripheral surface of a portion of the lower bearing member (70) protrudes radially outward, and is fixed to the inner peripheral surface of the barrel (21) of the casing (20).

An upper portion of the lower bearing member (70) has a smaller inside diameter than a lower portion thereof does. The inner surface of the upper portion of the lower bearing member (70) rotatably supports the main shaft portion (41) of the drive shaft (40). The lower portion of the lower bearing member (70) houses therein a lower end portion of the main shaft portion (41) of the drive shaft (40). The lower portion of the lower bearing member (70) has a lower recess (71) recessed upward. The lower recess (71) houses the lower end portion of the main shaft portion (41) of the drive shaft (40).

The upper portion of the lower bearing member (70) forms a lower bearing portion (72) that axially penetrates the lower bearing member (70) to communicate with a space inside the lower recess (71). The lower bearing portion (72) rotatably supports the main shaft portion (41) of the drive shaft (40). In this example, a third sliding bearing (72*a*) is fitted to the inner surface of the lower bearing portion (72). The lower bearing portion (72) rotatably supports the main shaft portion (41) of the drive shaft (40) with the third sliding bearing (72*a*) interposed therebetween.

Oil Pump

The oil pump (80) is provided at the lower end of the drive shaft (40), and is attached to the lower surface of the lower bearing member (70) to close the lower recess (71) of the lower bearing member (70). In this example, an intake nozzle (81) is provided as an intake member for sucking up oil. The intake nozzle (81) constitutes a positive-displacement oil pump (80).

An inlet (81*a*) of the intake nozzle (81) is open to the oil reservoir (26) of the casing (20). An outlet of the intake nozzle (81) is connected to the lower recess (71) to communicate with the lower recess (71). The oil sucked up from the oil reservoir (26) by the intake nozzle (81) flows through the oil supply channel (43) via the lower recess (71), and is supplied to the sliding components of the compressor (10).

Oil Discharge Passage

The housing (50) has an oil discharge passage (90) through which the lubricant remaining in the crank chamber (55) is to be discharged to the space (25) below the housing (50). The oil discharge passage (90) has an inflow end that opens to the crank chamber (55), and an outflow end that opens to the space (25) below the housing (50).

In this example, the oil discharge passage (90) has a first oil discharge passage (90*a*) and a second oil discharge passage (90*b*). The first oil discharge passage (90*a*) extends radially outward from the crank chamber (55). The second oil discharge passage (90*b*) extends downward from a front end portion of the first oil discharge passage (90*a*) to open to the space (25) below the housing (50).

Guide Plat

A guide plate (95) is provided below the outflow end of the oil discharge passage (90). The guide plate (95) is configured to guide the lubricant that has flowed out of the outflow end of the oil discharge passage (90) to the core cut (62*b*) of the stator (61). In this example, the lower end of the guide plate (95) is inserted into the core cut (62*b*) of the stator (61). For example, the guide plate (95) is formed in the shape of an arc-shaped plate along the inner peripheral surface of the casing (20). A circumferentially central portion of the guide plate (95) has a recessed portion. The recessed portion is recessed radially inward to form an oil return passage (a passage axially penetrating the guide plate (95)).

Operation of Compressor

Next, an operation of the compressor (10) will be described.

When the electric motor (60) rotates, the drive shaft (40) rotates so that the orbiting scroll (35) of the compression mechanism (30) is driven. The orbiting scroll (35) revolves around the axial center of the drive shaft (40) while having its rotation restricted. As a result, the low-pressure fluid (e.g., low-pressure gas refrigerant) is sucked from the suction pipe (27) into the compression chamber (C) of the compression mechanism (30), and is compressed. The fluid compressed in the compression chamber (C) (i.e., high-pressure fluid) is discharged through the discharge port (P) of the fixed scroll (31) to the discharge chamber (S).

The high-pressure fluid (e.g., high-pressure gas refrigerant) that has flowed into the discharge chamber (S) flows out of the discharge chamber (S) to the space (25) below the housing (50) through the discharge passage (not shown) formed in the fixed scroll (31) and the housing (50). The high-pressure fluid that has flowed into the space (25) below the housing (50) is discharged to the outside of the casing (20) (e.g., the condenser of the refrigerant circuit) through the discharge pipe (28).

Refrigerant Flow Around Electric Motor

Next, the flow of the gas refrigerant around the electric motor (60) will be described.

Figure 4:
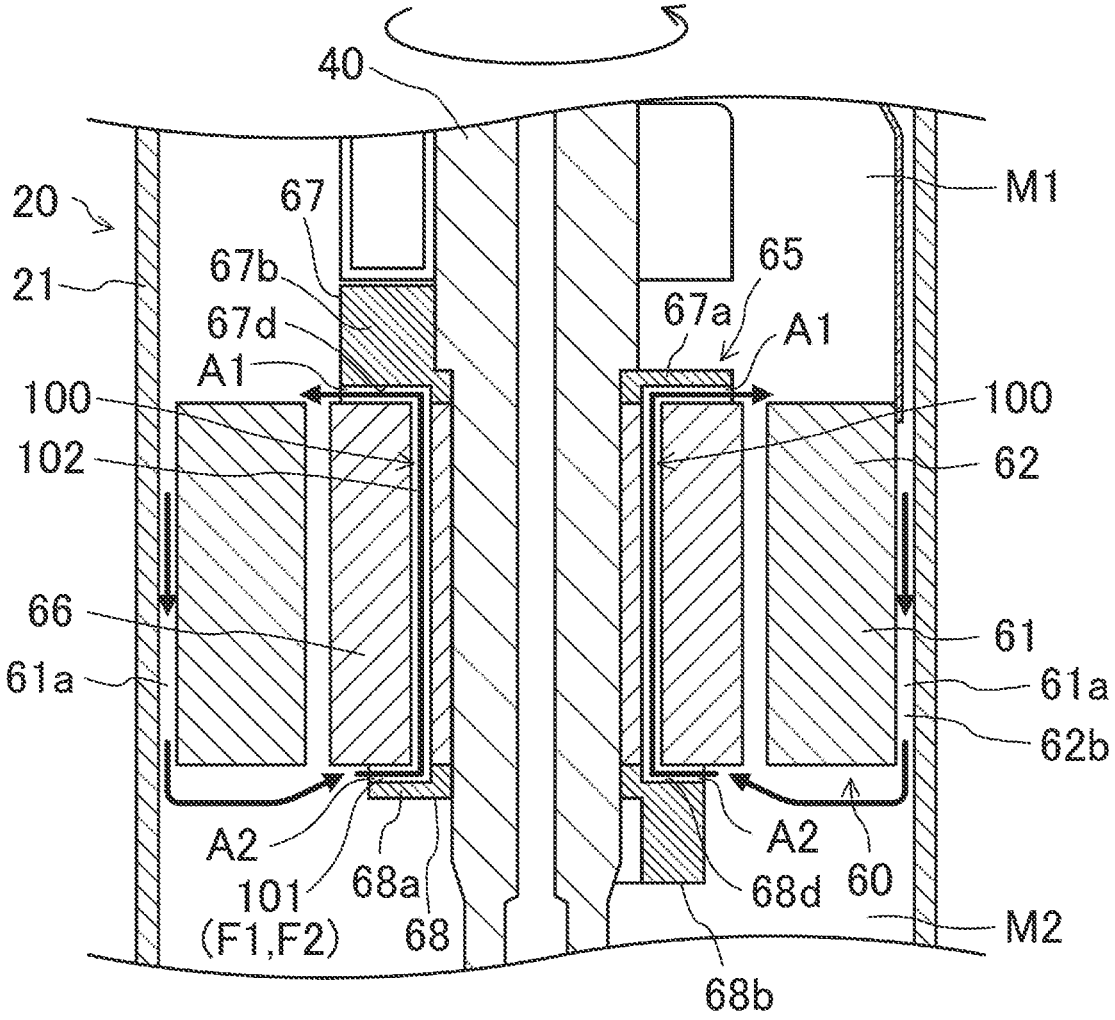
FIG. 4 is an explanatory drawing illustrating the flow of a refrigerant around an electric motor.

The gas refrigerant compressed in the compression mechanism (30) is discharged through the discharge port (P) to the discharge chamber (S). The discharged gas refrigerant is guided to the upper space (M1) and one of the gas flow paths (61*a*) by a passage (not shown) formed in the compression mechanism (30) and a guide member (not shown). As illustrated in FIG. 4, the gas refrigerant introduced into the one of the gas flow paths (61*a*) by the guide member flows down along the one of the gas flow paths (61*a*) from the upper end toward the lower end of the one of the gas flow paths (61*a*).

The gas refrigerant that has passed through the gas flow path (61*a*) flows through the lower space (M2) below the electric motor (60) into the inflow paths (101) of the refrigerant flow paths (100). Here, the rotor (66) rotates counterclockwise when the electric motor (60) is viewed from above. The gas refrigerant in the vicinity of the first and second openings (A1) and (A2) experiences a centrifugal force resulting from the rotation. The first openings (A1) are located radially outward of the second openings (A2) (toward the outer periphery of the rotor (66)). Thus, the gas refrigerant in the vicinity of the first openings (A1) experiences a higher centrifugal force than the gas refrigerant in the vicinity of the second openings (A2) does. Thus, the gas refrigerant flows through each of the refrigerant flow paths (100) from the second opening (A2) toward the first opening (A1). In other words, the gas refrigerant flowing through the refrigerant flow path (100) flows upward.

The gas refrigerant that has passed through the refrigerant flow paths (100) flows into a space between the housing (50) and the electric motor (60) (the upper space (M1) above the electric motor (60)). After that, the gas refrigerant flows out of the casing (20) through the discharge pipe (28).

Lubricant Flow Around Electric Motor

Next, the flow of the lubricant around the electric motor (60) will be described.

The gas refrigerant compressed in the compression mechanism (30) contains the lubricant in the form of droplets. Part of the lubricant contained in the gas refrigerant flowing through the one of the gas flow paths (61*a*) is deposited on the inner wall of the casing (20), and is assisted by the downward flow of the gas refrigerant to flow down along the inner wall. The lubricant that has reached the lower end of the one of the gas flow paths (61*a*) flows directly along the inner wall of the casing (20) to the bottom of the casing (20). As a result, the lubricant contained in the gas refrigerant is separated from the gas refrigerant, and accumulates in the oil reservoir (26).

The gas refrigerant that has reached the lower end of the one of the gas flow paths (61*a*) and from which most of the lubricant has been separated contains a small amount of the lubricant. This gas refrigerant passes through the lower space (M2) below the electric motor (60) to flow into the refrigerant flow path (100) from the second opening (A2) of the inflow path (101) of the refrigerant flow path (100) toward the radially inner side (the axial center of the rotor (66)).

Here, the rotor (66) rotates counterclockwise when the electric motor (60) is viewed from above. Some of oil droplets which are contained in the gas refrigerant in the vicinity of the second openings (A2) which have a relatively large particle size are splashed radially outward by the action of a relatively high centrifugal force resulting from this rotation. The centrifugal force acting on the remaining oil droplets having a relatively small particle size is low. Thus, these oil droplets are caught in the gas refrigerant flowing through the refrigerant flow paths (100) to flow radially inward of the second openings (A2), and thus move upward through the rotor flow paths (102). This can keep the lubricant from being transferred to the upper space (M1) above the electric motor (60). In other words, the inflow paths (101) reduce the flow of the lubricant in the gas refrigerant into the refrigerant flow paths (100).

As can be seen, the gas refrigerant from which the lubricant has been further separated in the inflow paths (101) flows through the refrigerant flow paths (100) into the space between the housing (50) and the electric motor (60) (the upper space (M1) above the electric motor (60)), and flows out of the casing (20) through the discharge pipe (28).

Feature (1) of First Embodiment

The compressor (10) of this embodiment includes the casing (20), the electric motor (60) housed in the internal space (M) of the casing (20), the drive shaft (40) rotated by the electric motor (60), and the compression mechanism (30) driven by the drive shaft (40) to discharge the compressed refrigerant to the internal space (M). The internal space (M) includes the upper space (M1) formed near one axial end of the electric motor (60), and the lower space (M2) formed near the other axial end of the electric motor (60). The electric motor (60) includes the stator (61) fixed to the casing (20), and the rotating member (65) including the rotor (66) rotatably inserted into the stator (61). The electric motor (60) has the refrigerant flow paths (100) through each of which the upper and lower spaces (M1) and (M2) communicate with each other. The refrigerant flow paths (100) each include the first flow path (F1) into which the refrigerant in the lower space (M2) flows, and the rotor flow path (102) extending axially across the rotor (66) and connected to the outflow end of the first flow path (F1). The first flow paths (F1) are each configured to reduce the flow of the oil in the refrigerant into the refrigerant flow path (100).

The refrigerant passing through the rotor flow paths (102) of the rotor (66) contains the lubricant. The passage of the refrigerant through the rotor flow paths (102) has sometimes caused the amount of the oil supplied from the upper space (M1) above the electric motor (60) to the lower space (M2) below the electric motor (60) to be excessive.

In the compressor (10) of this embodiment, the first flow paths (F1) reduce the flow of the oil in the refrigerant flowing into the refrigerant flow paths (100). According to this embodiment, the amount of the oil flowing through the refrigerant flow paths (100) into the upper space (M1) can be kept from being excessive.

Feature (2) of First Embodiment

The first flow paths (F1) of this embodiment each include the second flow path (F2) extending from the rotor flow path (102) toward the outer periphery of the rotor (66).

In the compressor (10) of this embodiment, the electric motor (60) rotates. Due to this rotation, a centrifugal force acts on the oil droplets contained in the refrigerant in the vicinity of the inflow ends of the second flow paths (F2). Some of the oil droplets with a larger particle size which have experienced the centrifugal force are splashed toward the outer periphery of the rotor (66). This makes it difficult for the oil to flow into the second flow paths (F2). According to this embodiment, the flow of the oil into the refrigerant flow paths (100) can be reduced.

Feature (3) of First Embodiment

The rotating member (65) of this embodiment includes the balance weights (67, 68) fixed to the axial ends of the rotor (66). The first flow paths (F1) are formed in one of the balance weights (67, 68).

Here, an electric motor (60) including a rotor (66) having first flow paths (F1) has lower efficiency than an electric motor (60) including a rotor (66) without first flow paths (F1). In the compressor (10) of this embodiment, the first flow paths (F1) are formed in the lower balance weight (68). This can reduce a decrease in the efficiency of the electric motor (60), compared to the case where first flow paths (F1) are formed in a rotor (66).

Furthermore, in the compressor (10) of this embodiment, the first flow paths (F1) are formed in one of the balance weights (67, 68), which are existing components. This eliminates the need for adding another component.

Feature (4) of First Embodiment

The refrigerant flow paths (100) of this embodiment each include the outflow path (103) having the first opening (A1) that opens to the upper space (M1), and the inflow path (101) having the second opening (A2) that opens to the lower space (M2). Each outflow path (103) extends from the rotor flow path (102) toward the outer periphery of the rotor (66), and has the first opening (A1) closer to the outer periphery of the rotor (66) than the second opening (A2).

In the compressor (10) of this embodiment, the first openings (A1) are closer to the outer periphery of the rotor (66) than the second openings (A2) are. Thus, the centrifugal force acting on the refrigerant in the vicinity of the first openings (A1) is higher than the centrifugal force acting on the refrigerant in the vicinity of the second openings (A2). For this reason, the refrigerant flows from the second openings (A2) toward the first openings (A1). According to this embodiment, utilizing the difference in centrifugal force acting on the refrigerant between the outflow paths (103) and the inflow paths (101) allows the refrigerant and oil to be transferred from the second openings (A2) to the first openings (A1). The amounts of the refrigerant and oil to be transferred can be controlled by the centrifugal force.

Feature (5) of First Embodiment

The upper space (M1) of this embodiment is located above the electric motor (60), and the lower space (M2) is located below the electric motor (60) to form the oil reservoir (26) in which the oil is stored. The outer peripheral surface of the stator (61) has the grooves through each of which the upper and lower spaces (M1) and (M2) communicate with each other. The first openings (A1) open to the upper space (M1), and the second openings (A2) open to the lower space (M2).

In the compressor (10) of this embodiment, the oil in the upper space (M1) flows down through the grooves of the outer peripheral surface of the stator (61) together with the refrigerant, and reaches the lower space (M2). The oil that has reached the lower space (M2) is stored in the oil reservoir (26). The refrigerant from which the oil has been separated in the lower space (M2) by a swirl flow flows upward through the refrigerant flow paths (100) from the second openings (A2) that open to the lower space (M2), and flows out to the upper space (M1) through the first openings (A1) that open to the upper space (M1). As a result, a circulating flow of the gas refrigerant can be produced to return the oil in the upper space (M1) inside the compressor (10) to the lower space (M2). The flow rate of the gas refrigerant flowing through the refrigerant flow paths (100) can be determined by the centrifugal force.

Feature (6) of First Embodiment

The first flow paths (F1) of this embodiment each include the second flow path (F2) extending from the rotor flow path (102) toward the outer periphery of the rotor (66). The inflow paths (101) are the second flow paths (F2).

In the compressor (10) of this embodiment, the oil blended into the refrigerant in the lower space (M2) can be kept from flowing into the refrigerant flow paths (100), and the oil in the lower space (M2) can be returned to the oil reservoir (26).

Variations of First Embodiment

First Variation

Figure 5:
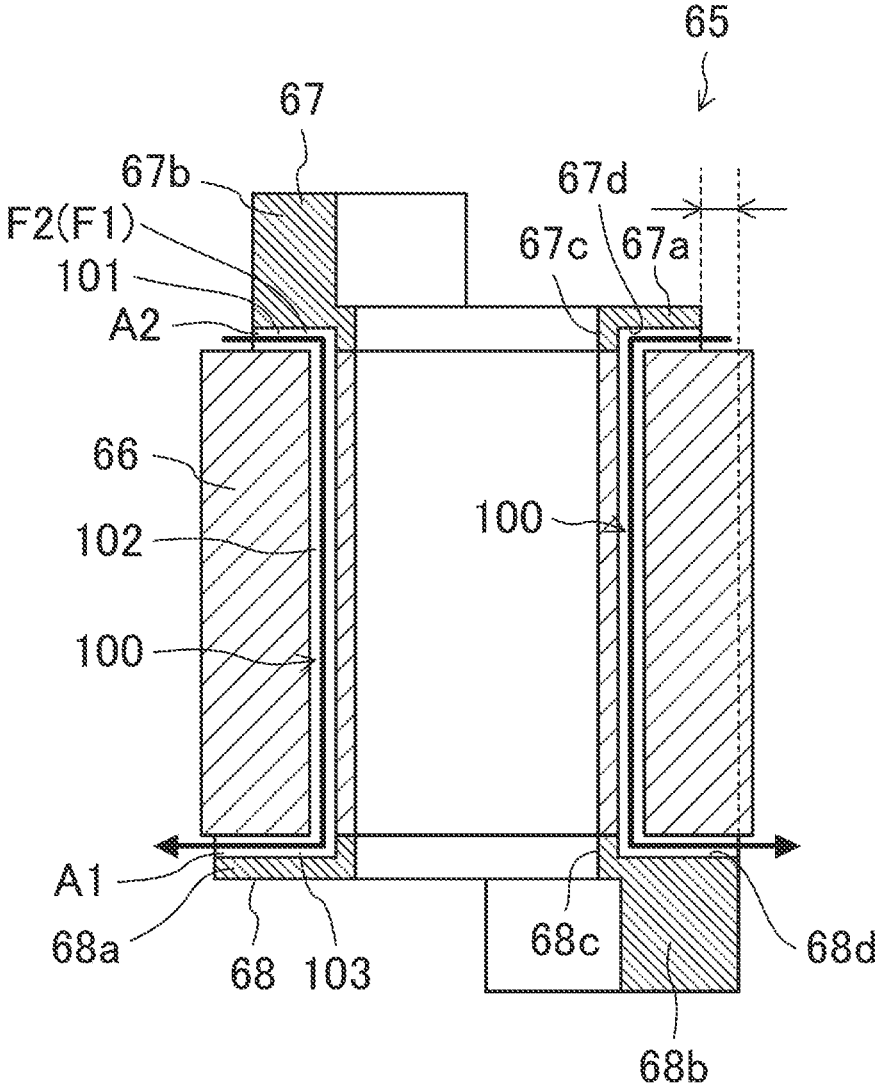
FIG. 5 corresponds to FIG. 3 and illustrates a first variation of the first embodiment.

As illustrated in FIG. 5, the inflow paths (101) of the compressor (10) of this embodiment may be formed in the upper balance weight (67), and the outflow paths (103) may be formed in the lower balance weight (68). In this variation, the inflow paths (101), the rotor flow paths (102), and the outflow paths (103) are formed in this order from the top to the bottom.

Specifically, the inflow paths (101) are passages through each of which the gas refrigerant in the upper space (M1) above the electric motor (60) flows into the rotor flow path (102). The inflow paths (101) are formed between the recesses (67*d*) of the upper balance weight (67) and the upper end surface of the rotor (66). The inflow paths (101) each have a second opening (A2) that opens to the upper space (M1) above the electric motor (60).

The outflow paths (103) are passages through each of which the gas refrigerant that has passed through the rotor flow path (102) is guided to the lower space (M2) below the electric motor (60). The outflow paths (103) are formed between the recesses (68*d*) of the lower balance weight (68) and the lower end surface of the rotor (66). The outflow paths (103) each have a first opening (A1) that opens to the lower space (M2) below the electric motor (60).

The flow of the gas refrigerant around the electric motor (60) according to this variation will be described.

The gas refrigerant compressed in the compressor (10) is discharged through the discharge port (P) to the discharge chamber (S). The discharged gas refrigerant is guided to the upper space (M1) above the electric motor (60) by a passage (not shown) formed in the compression mechanism (30). As illustrated in FIG. 5, the gas refrigerant guided to the upper space (M1) above the electric motor (60) flows into the inflow paths (101) of the refrigerant flow paths (100).

Here, the rotor (66) rotates counterclockwise when the electric motor (60) is viewed from above. The gas refrigerant in the vicinity of the first and second openings (A1) and (A2) experiences a centrifugal force resulting from this rotation. The first openings (A1) are located radially outward of the second openings (A2) (toward the outer periphery of the rotor (66)). Thus, the gas refrigerant in the vicinity of the first openings (A1) experiences a higher centrifugal force than the gas refrigerant in the vicinity of the second openings (A2) does. Thus, the gas refrigerant flows through each of the refrigerant flow paths (100) from the second opening (A2) toward the first opening (A1). In other words, the gas refrigerant flowing through the refrigerant flow paths (100) flows downward.

Next, the flow of the lubricant around the electric motor (60) according to this variation will be described.

The gas refrigerant that has been compressed in the compression mechanism (30) and that has reached the upper space (M1) above the electric motor (60) contains the lubricant in the form of droplets. The gas refrigerant containing this lubricant flows into the refrigerant flow paths (100) from the second openings (A2) of the inflow paths (101) of the refrigerant flow paths (100) toward the radially inner side (the axial center of the rotor (66)).

Here, the rotor (66) rotates counterclockwise when the electric motor (60) is viewed from above. Some of oil droplets which are contained in the gas refrigerant in the vicinity of the second openings (A2) which have a relatively large particle size are splashed radially outward by the action of a relatively high centrifugal force resulting from this rotation. The centrifugal force acting on the remaining oil droplets having a relatively small particle size is low. Thus, these oil droplets are caught in the gas refrigerant flowing through the refrigerant flow paths (100) to flow radially inward of the second openings (A2), and thus move down through the rotor flow paths (102). This can reduce the lubricant to be transferred to the lower space (M2) below the electric motor (60).

Second Embodiment

A second embodiment will be described below. A compressor (10) of this embodiment is obtained by modifying the configuration of the inflow path (101) included in each of the refrigerant flow paths (100) of the compressor (10) of the first embodiment. Thus, the following description will be focused on the differences between the compressor (10) of this embodiment and the compressor (10) of the first embodiment.

Inflow Path

Figure 6:
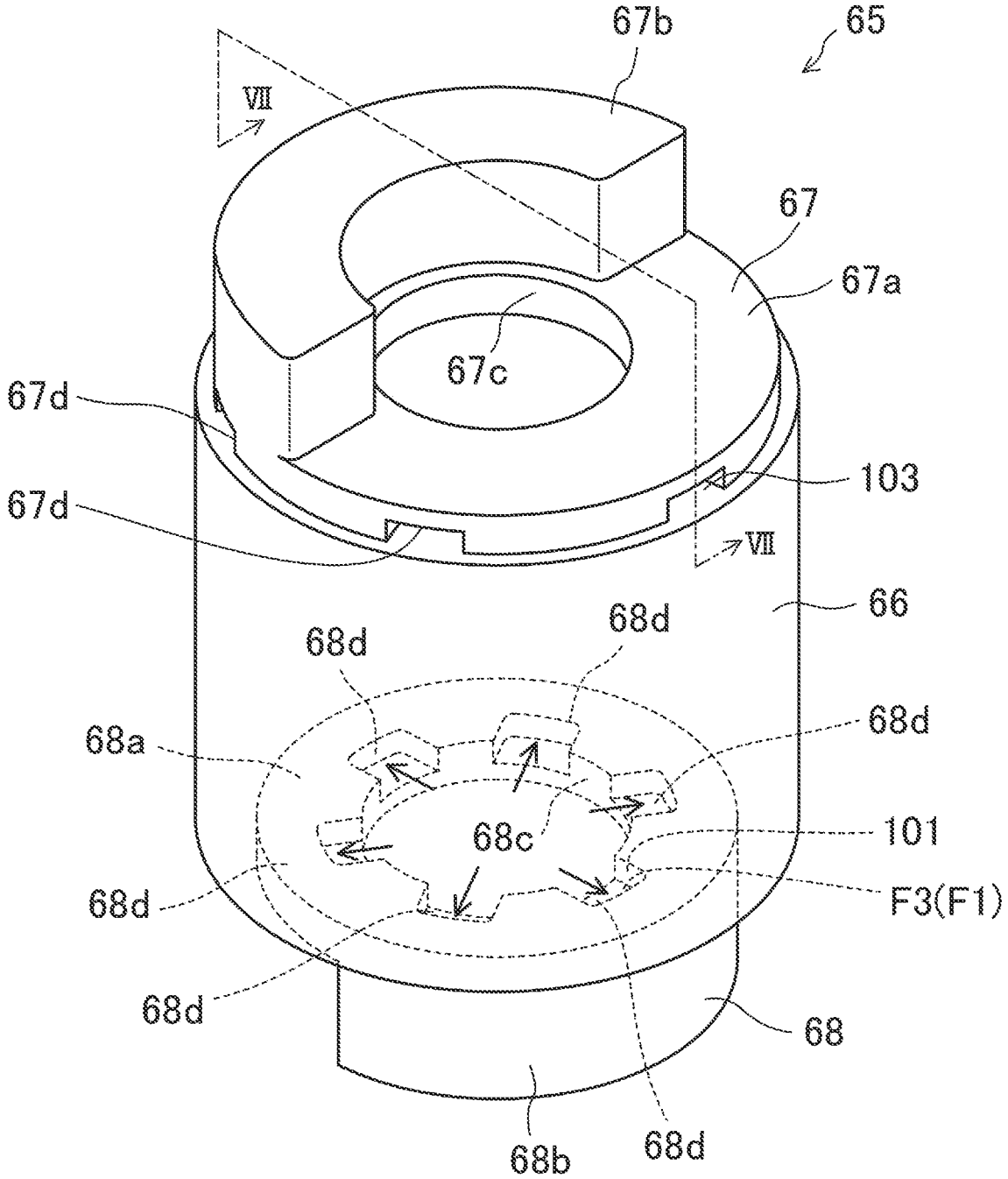
FIG. 6 corresponds to FIG. 2 and illustrates a second embodiment.
Figure 7:
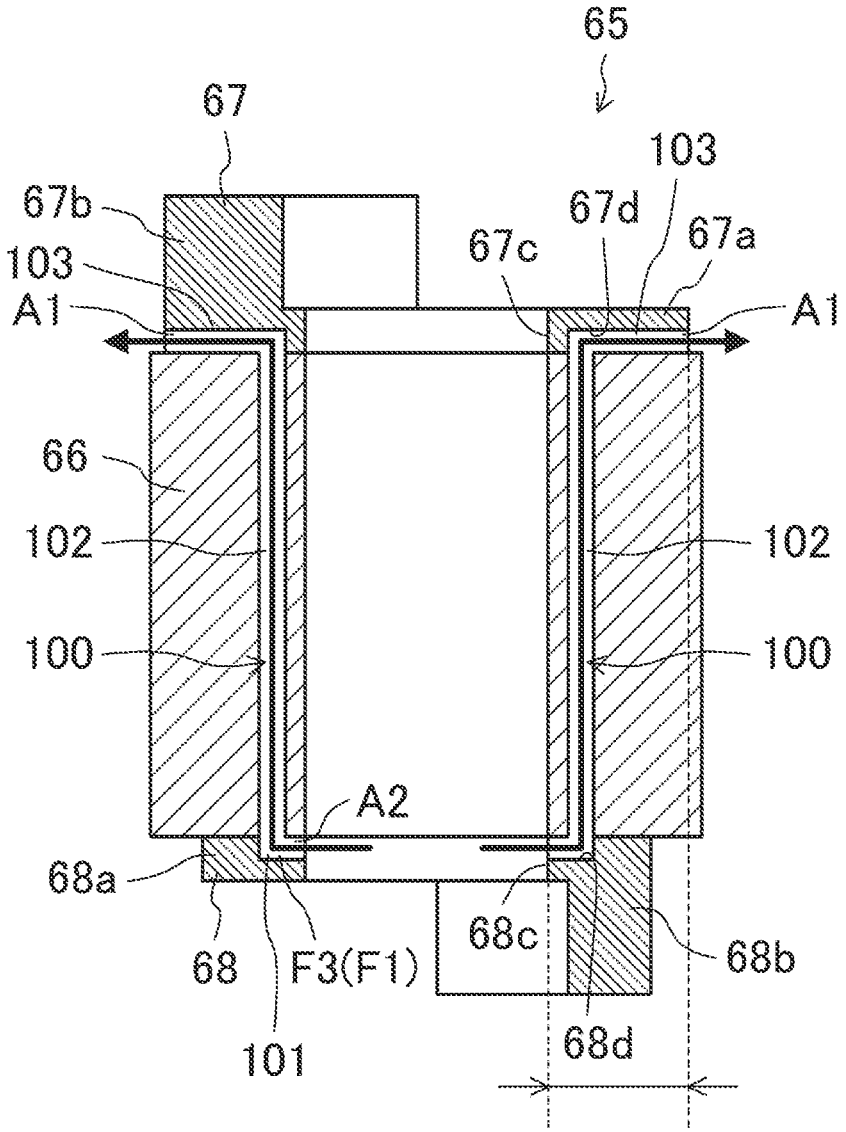
FIG. 7 is a cross-sectional view taken along line VII-VII in FIG. 6.

As illustrated in FIGS. 6 and 7, an inflow path (101) of each of refrigerant flow paths (100) of the compressor (10) of this embodiment may be a third flow path (F3) extending radially inward (toward the axial center of the rotor (66)) from the inflow end of a rotor flow path (102). In this embodiment, the third flow paths (F3) correspond to first flow paths (F1) of the present invention.

As illustrated in FIG. 6, a surface (an upper surface) of a flat plate portion (68*a*) of a lower balance weight (68) which has third flow paths (F3) which is opposite to another surface thereof on which a weight portion (68*b*) is formed has a plurality of recesses (68*d*) extending radially inward. In this embodiment, the number of the recesses (68*d*) is six. The recesses (68*d*) are formed at predetermined intervals along the circumferential direction. Each recess (68*d*) has its radially inner end (one end) opened, and has its radially outer end (the other end) closed. The recesses (68*d*) have a width and depth that are uniform in the radial direction.

As illustrated in FIG. 7, the third flow paths (F3) are formed between the recesses (68*d*) of the lower balance weight (68) and the lower end surface of the rotor (66). In other words, the third flow paths (F3) are formed in the lower balance weight (68). The third flow paths (F3) each have a second opening (A2) that opens to the lower space (M2) below the electric motor (60). Each second opening (A2) is the inflow end of the third flow path (F3) and the inflow end of the inflow path (101). The second opening (A2) is formed in the shape of a rectangle with the long sides oriented in the circumferential direction and the short sides oriented in the top-to-bottom direction. The second opening (A2) opens toward the axial center of the rotor (66).

The outflow end of each third flow path (F3) is connected to the inflow end of the rotor flow path (102). The third flow paths (F3) extend radially inward (toward the axial center of the rotor (66)) from the inflow ends of the rotor flow paths (102). Each third flow path (F3) has a width and height that are uniform in the radial direction. In this embodiment, the number of the third flow paths (F3) is six. First openings (A1) of outflow paths (103) are located radially outward of the second openings (A2) (toward the outer periphery of the rotor (66)).

Lubricant Flow Around Electric Motor

A gas refrigerant present in the lower space (M2) below the electric motor (60) contains lubricant. This gas refrigerant flows into the refrigerant flow paths (100) from the second openings (A2) of the inflow paths (101) of the refrigerant flow paths (100) toward the radially outer side (the outer periphery of the rotor (66)).

Here, the rotor (66) rotates counterclockwise when the electric motor (60) is viewed from above. Some of oil droplets which are contained in the gas refrigerant in the vicinity of the second openings (A2) which have a relatively large particle size are splashed radially outward by the action of a relatively high centrifugal force resulting from this rotation. The splashed lubricant collides with a wall that closes the recesses (68*d*) of the lower balance weight (68), and moves upward through the rotor flow paths (102) together with the gas refrigerant.

This can facilitate transferring the lubricant to the upper space (M1) above the electric motor (60). In other words, the inflow paths (101) facilitate the flow of the lubricant in the gas refrigerant into the upper space (M1).

Feature (1) of Second Embodiment

The compressor (10) of this embodiment includes the casing (20), the electric motor (60) housed in the internal space (M) of the casing (20), the drive shaft (40) rotated by the electric motor (60), and the compression mechanism (30) driven by the drive shaft (40) to discharge the compressed refrigerant to the internal space (M). The internal space (M) includes the upper space (M1) formed near one axial end of the electric motor (60), and the lower space (M2) formed near the other axial end of the electric motor (60). The electric motor (60) includes the stator (61) fixed to the casing (20), and the rotating member (65) including the rotor (66) rotatably inserted into the stator (61). The electric motor (60) has the refrigerant flow paths (100) through each of which the upper and lower spaces (M1) and (M2) communicate with each other. The refrigerant flow paths (100) each include the first flow path (F1) into which the refrigerant in the lower space (M2) flows, and the rotor flow path (102) extending axially across the rotor (66) and connected to the outflow end of the first flow path (F1). The first flow paths (F1) are configured to facilitate the flow of the oil in the refrigerant into the refrigerant flow paths (100).

The refrigerant passing through the rotor flow paths (102) of the rotor (66) contains the lubricant. The passage of the refrigerant through the rotor flow paths (102) has sometimes caused the amount of the oil supplied from the upper space (M1) above the electric motor (60) to the lower space (M2) below the electric motor (60) to be insufficient.

In the compressor (10) of this embodiment, the first flow paths (F1) facilitate the flow of the oil in the refrigerant into the refrigerant flow paths (100). As a result, according to this embodiment, the amount of the oil flowing through the refrigerant flow paths (100) into the upper space (M1) can be kept from being insufficient.

Feature (2) of Second Embodiment

The first flow paths (F1) of this embodiment each include the third flow path (F3) extending from the rotor flow path (102) toward the axial center of the rotor (66).

When the electric motor (60) of the compressor (10) of this embodiment rotates, this rotation causes a centrifugal force to act on the oil droplets contained in the refrigerant in the vicinity of the inflow ends of the third flow paths (F3). Some of the oil droplets with a larger particle size which have experienced the centrifugal force are splashed toward the outer periphery of the rotor (66). The splashed oil droplets collide with the wall that closes the recesses (68*d*) of the lower balance weight (68), and move upward through the rotor flow paths (102) together with the refrigerant. This makes it easy for the oil to flow into the third flow paths (F3). According to this embodiment, the flow of the oil into the refrigerant flow paths (100) can be facilitated.

Variations of Second Embodiment

First Variation

Figure 8:
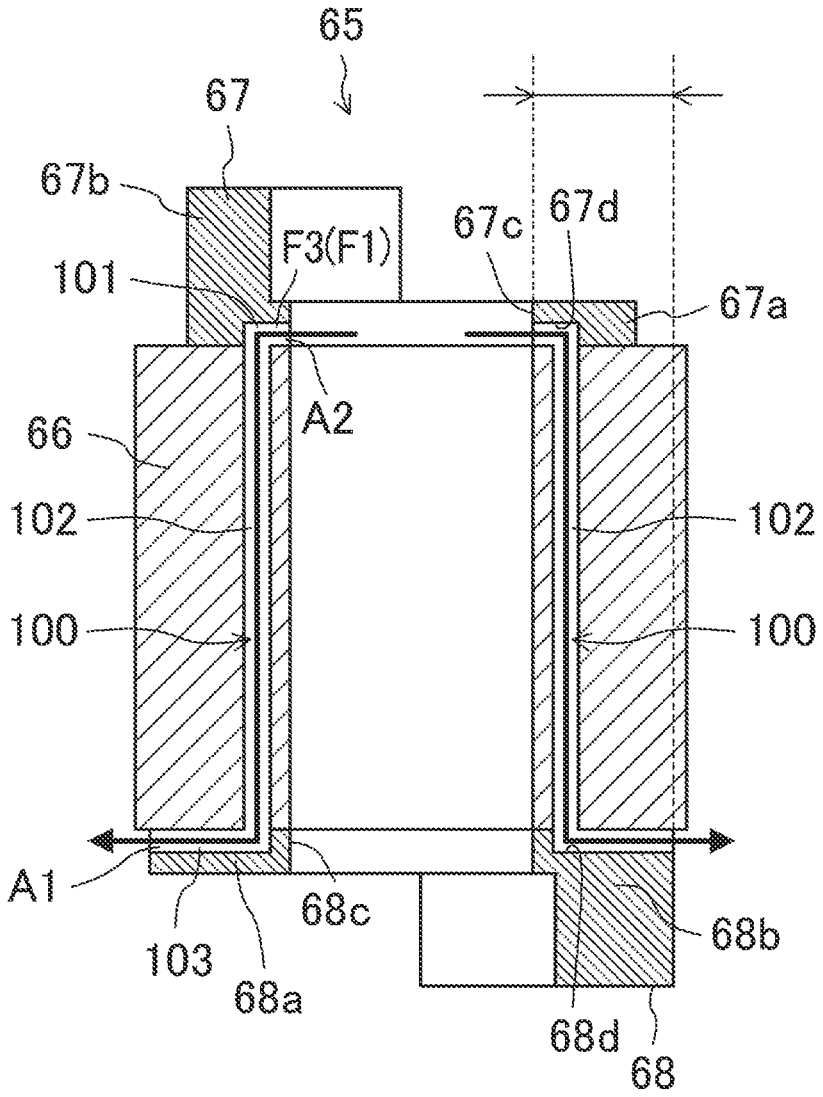
FIG. 8 corresponds to FIG. 3 and illustrates a first variation of the second embodiment.

As illustrated in FIG. 8, the inflow paths (101) of the compressor (10) of this embodiment may be formed in the upper balance weight (67), and the outflow paths (103) may be formed in the lower balance weight (68). In this variation, the inflow paths (101), the rotor flow paths (102), and the outflow paths (103) are formed in this order from the top to the bottom.

Specifically, each inflow path (101) is a passage through which the gas refrigerant in the upper space (M1) above the electric motor (60) flows into the rotor flow paths (102). The inflow paths (101) are formed between the recesses (67*d*) of the upper balance weight (67) and the upper end surface of the rotor (66). The inflow paths (101) each have a second opening (A2) that opens to the upper space (M1) above the electric motor (60).

Each outflow path (103) is a passage through which the gas refrigerant that has passed through the rotor flow path (102) is guided to the lower space (M2) below the electric motor (60). The outflow paths (103) are formed between the recesses (68*d*) of the lower balance weight (68) and the lower end surface of the rotor (66). The outflow paths (103) each have a first opening (A1) that opens to the lower space (M2) below the electric motor (60).

The flow of the gas refrigerant around the electric motor (60) according to this variation will be described.

The gas refrigerant compressed in the compressor (10) is discharged through the discharge port (P) to the discharge chamber (S). The discharged gas refrigerant is guided to the upper space (M1) above the electric motor (60) by a passage (not shown) formed in the compression mechanism (30). As illustrated in FIG. 8, the gas refrigerant guided to the upper space (M1) above the electric motor (60) flows into the inflow paths (101) of the refrigerant flow paths (100).

Here, the rotor (66) rotates counterclockwise when the electric motor (60) is viewed from above. The gas refrigerant in the vicinity of the first and second openings (A1) and (A2) experiences a centrifugal force resulting from this rotation. The first openings (A1) are located radially outward of the second openings (A2) (toward the outer periphery of the rotor (66)). Thus, the gas refrigerant in the vicinity of the first openings (A1) experiences a higher centrifugal force than the gas refrigerant in the vicinity of the second openings (A2) does.

Thus, the gas refrigerant flows through each of the refrigerant flow paths (100) from the second opening (A2) toward the first opening (A1). In other words, the gas refrigerant flowing through the refrigerant flow paths (100) flows downward.

Next, the flow of the lubricant around the electric motor (60) according to this variation will be described.

The gas refrigerant which has been compressed in the compression mechanism (30) and which has reached the upper space (M1) above the electric motor (60) contains the lubricant in the form of droplets. The gas refrigerant containing the lubricant flows into the refrigerant flow paths (100) from the second openings (A2) of the inflow paths (101) of the refrigerant flow paths (100) toward the radially outer side (the outer periphery of the rotor (66)).

Here, the rotor (66) rotates counterclockwise when the electric motor (60) is viewed from above. Some of oil droplets which are contained in the gas refrigerant in the vicinity of the second openings (A2) which have a relatively large particle size are splashed radially outward by the action of a relatively high centrifugal force resulting from this rotation. The splashed lubricant collides with the wall that closes the recesses (67*d*) of the upper balance weight (67), and moves downward through the rotor flow paths (102) together with the gas refrigerant. This can facilitate transferring the lubricant to the lower space (M2) below the electric motor (60).

Second Variation

Figure 9:
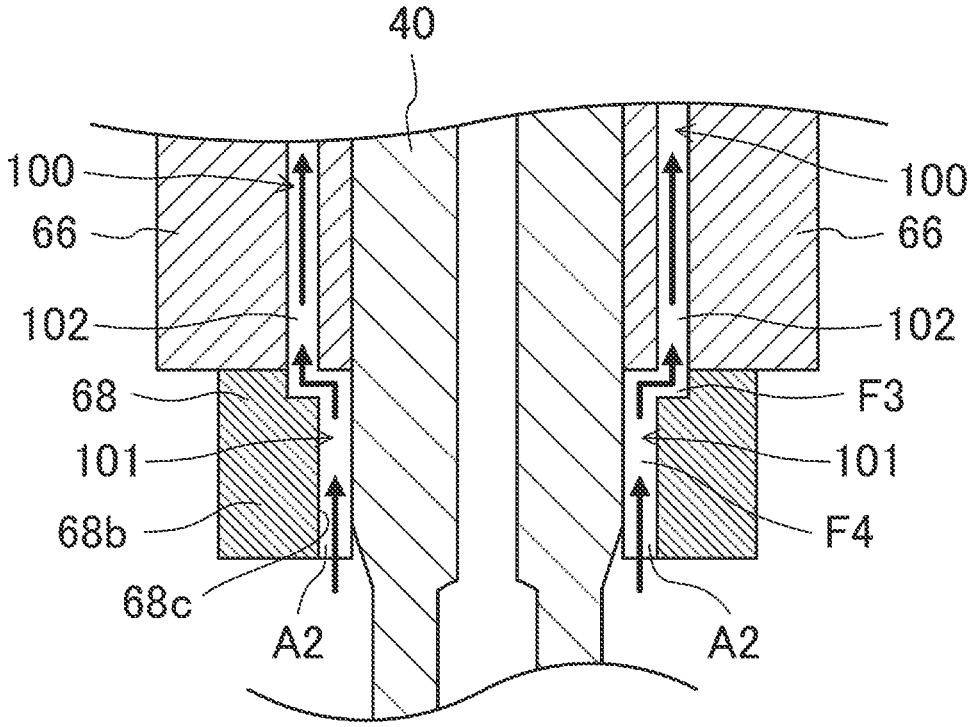
FIG. 9 is a vertical sectional view illustrating a lower portion of an electric motor according to a second variation of the second embodiment.

As illustrated in FIG. 9, refrigerant flow paths (100) of the compressor (10) of this embodiment may include an inflow path (101) that includes a third flow path (F3) and a fourth flow path (F4). The fourth flow path (F4) and the third flow path (F3) are formed in this order from the bottom to the top.

The fourth flow path (F4) is formed along the outer peripheral surface of the drive shaft (40). Specifically, the fourth flow path (F4) is formed between the outer peripheral surface of the drive shaft (40) and the inner surface defining the through hole (68*c*) of the lower balance weight (68). The fourth flow path (F4) extends from the upper end to the lower end of the lower balance weight (68) in the top-to-bottom direction. The fourth flow path (F4) is formed in the shape of a tube to surround the outer peripheral surface of the drive shaft (40). The fourth flow path (F4) has a second opening (A2) that opens to the lower space (M2) below the electric motor (60).

The second opening (A2) is the inflow end of the fourth flow path (F4) and the inflow end of the inflow path (101). The second opening (A2) is formed in the shape of a ring to surround the outer peripheral surface of the drive shaft (40). The second opening (A2) opens downward. The fourth flow path (F4) communicates with the third flow path (F3). Specifically, the outflow end of the fourth flow paths (F4) is connected to the inflow end of the third flow path (F3). The radial width of the fourth flow path (F4) is uniform in the top-to-bottom direction.

Features of Second Variation

The rotating member (65) of this variation includes the balance weights (67, 68) fixed to the axial ends of the rotor (66) and each having the through hole (67*c*, 68*c*) through which the drive shaft (40) passes. The fourth flow path (F4) is formed between the outer peripheral surface of the drive shaft (40) and the inner surface defining the through hole (67*c*, 68*c*) of the associated balance weight (67, 68).

In the compressor (10) of this variation, the fourth flow path (F4) does not have to be formed in the lower balance weight (68). This can substantially prevent the size of the balance weight (67, 68) from increasing.

Third Embodiment

Figure 10:
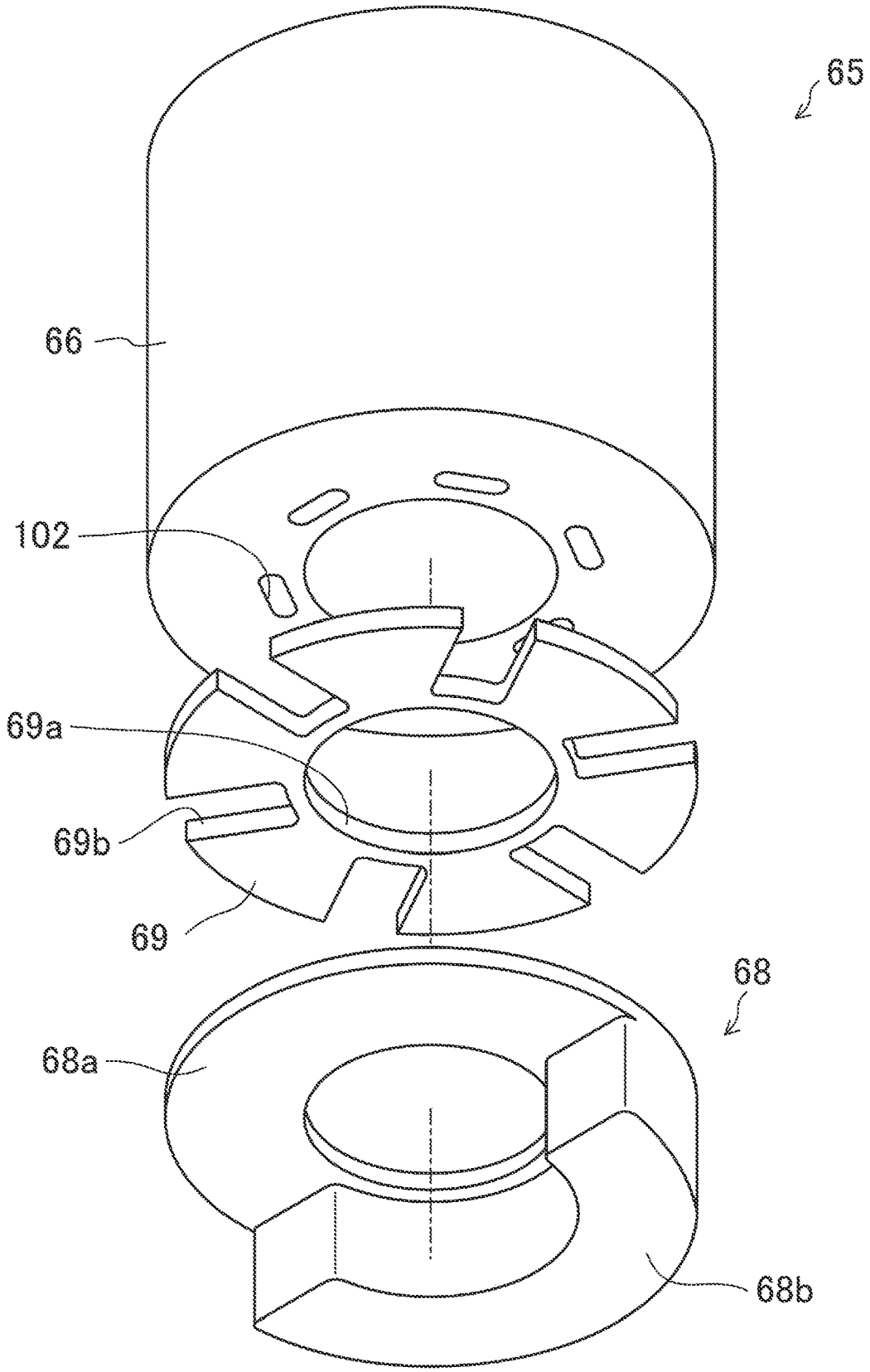
FIG. 10 is an exploded perspective view of a lower portion of a rotating member according to a third embodiment.

Refrigerant flow paths (100) of a compressor (10) of this embodiment may have their inflow paths (101) or their outflow paths (103) formed in an end piece (69). Specifically, for example, as illustrated in FIG. 10, a rotating member (65) may include a rotor (66), the end piece (69), and a lower balance weight (68).

The lower balance weight (68) is fixed to the lower axial end of the rotor (66) with the end piece (69) interposed therebetween. In other words, the end piece (69) is disposed between the lower balance weight (68) and the rotor (66). The end piece (69) is a plate-shaped member formed in the shape of a ring. The outside diameter of the end piece (69) is substantially equal to that of a flat plate portion (68*a*) of the lower balance weight (68).

A central portion of the end piece (69) has a through hole (69*a*) through which the drive shaft (40) passes. The end piece (69) has a plurality of notches (69*b*) cut out in the thickness direction (top-to-bottom direction). In this embodiment, the number of the notches (69*b*) is six.

The notches (69*b*) are formed radially inward from the outer edge of the end piece (69). The transverse section of each notch (69*b*) is generally U-shaped. The notch (69*b*) has a circumferential length that is less than the radial length thereof.

The inflow path (101) of each of the refrigerant flow paths (100) of this embodiment is a second flow path (F2) extending radially outward (toward the outer periphery of the rotor (66)) from the inflow end of a rotor flow path (102). The second flow paths (F2) are defined by the upper end surface of the lower balance weight (68), the notches (69*b*) of the end piece (69), and the lower end surface of the rotor (66). In other words, the second flow paths (F2) are formed in the end piece (69). In this embodiment, the second flow paths (F2) formed in the end piece (69) correspond to the first flow paths (F1) of the present invention.

Feature (1) of Third Embodiment

The rotating member (65) of this embodiment includes the balance weight (67, 68) fixed to an axial end of the rotor (66), and the end piece (69) disposed between the balance weight (67, 68) and the rotor (66). The first flow paths (F1) are formed in the end piece (69).

In the compressor (10) of this embodiment, the first flow paths (F1) are not formed in the balance weight (67, 68). Thus, the degree of freedom in design of the balance weight (67, 68) is maintained.

OTHER EMBODIMENTS

The above-described embodiments may be modified in the following manner.

The compressor (10) of each of the foregoing embodiments may be a horizontal compressor, and may be a compressor except a scroll compressor (e.g., a rotary compressor).

In the compressor (10) of each of the foregoing embodiments, the upper space (M1) above the electric motor (60) is the first space, and the lower space (M2) below the electric motor (60) is the second space. Conversely, the upper space (M1) above the electric motor (60) may be the second space, and the lower space (M2) below the electric motor (60) may be the first space.

The refrigerant in the lower space (M2) flows into the first flow paths (F1) of each of the foregoing embodiments. However, the refrigerant in the upper space (M1) may flow into the first flow paths (F1).

The first openings (A1) of each of the foregoing embodiments open to the upper space (M1), and the second openings (A2) open to the lower space (M2). Conversely, the first openings (A1) may open to the lower space (M2), and the second openings (A2) may open to the upper space (M1).

The balance weights (67, 68) of each of the foregoing embodiments are provided on both axial ends of the rotor (66). However, a balance weight (67, 68) may be provided on either the upper or lower end of the rotor (66).

The recesses (67*d*, 68*d*) of the balance weights (67, 68) of each of the first and second embodiments are formed in the associated flat plate portions (67*a*, 68*a*). However, the recesses (67*d*, 68*a*) do not have to be formed in the associated flat plate portions (67*a*, 68*a*), and may be formed in another portion of the balance weights (67, 68).

The inflow paths (101) of each of the foregoing embodiments may be axially or radially inclined as long as a centrifugal force acts on the gas refrigerant in the inflow paths (101).

In each of the foregoing embodiments, the first and second openings (A1, A2) do not have to be rectangular.

While the embodiments and variations thereof have been described above, it will be understood that various changes in form and details may be made without departing from the spirit and scope of the claims. The foregoing embodiments and variations thereof may be combined and replaced with each other without deteriorating the intended functions of the present disclosure.

As can be seen from the foregoing description, the present disclosure is useful for a compressor.

The invention claimed is:

1. A compressor, comprising:

a casing;

an electric motor housed in an internal space of the casing;

a drive shaft rotated by the electric motor; and a compression mechanism driven by the drive shaft to compress a refrigerant and discharge the compressed refrigerant to the internal space, the internal space including a first space formed near one axial end of the electric motor, and a second space formed near an other axial end of the electric motor, the electric motor including a stator and a rotating member, the stator being fixed to the casing, the rotating member including a rotor rotatably inserted into the stator, the electric motor having a refrigerant flow path through which the first and second spaces communicate with each other, the refrigerant flow path including a first flow path into which the refrigerant in the first space or the second space flows, and a rotor flow path extending axially across the rotor and connected to an outflow end of the first flow path, the first flow path including a second flow path into which the refrigerant flows from the internal space and that extends radially outward of the rotor from the rotor flow path, a radial length of the second flow path being longer than a circumferential length of the second flow path, the second flow path having an inflow end opening onto an outer peripheral surface of the rotating member, the second flow path being substantially perpendicular to the outer peripheral surface, and the second flow path having an outflow end connected to an inflow end of the rotor flow path.

2. A compressor, comprising:

a casing;

an electric motor housed in an internal space of the casing, a drive shaft rotated by the electric motor; and a compression mechanism driven by the drive shaft to compress a refrigerant and discharge the compressed refrigerant to the internal space, the internal space including a first space formed near one axial end of the electric motor, and a second space formed near an other axial end of the electric motor, the electric motor including a stator and a rotating member, the stator being fixed to the casing, the rotating member including a rotor rotatablv inserted into the stator, the electric motor having a refrigerant flow path through which the first and second spaces communicate with each other, the refrigerant flow path including a first flow path into which the refrigerant in the first space or the second space flows, a rotor flow path extending axially across the rotor and connected to an outflow end of the first flow path, an outflow path having a first opening that opens to one of the first space or the second space, and an inflow path having a second opening that opens to an other one of the first space or the second space, the refrigerant flowing from the other one of the first space or the second space into the inflow path, the outflow path extending from the rotor flow path toward an outer periphery of the rotor, the first opening being closer to the outer periphery of the rotor than the second opening, the inflow path extending radially outward of the rotor from the rotor flow hath, a radial length of the inflow path being longer than a circumferential length of the inflow path, the second opening, which is an inflow end of the inflow path, opening onto an outer peripheral surface of the rotating member, the inflow path being substantially perpendicular to the outer peripheral surface, and the inflow path having an outflow end connected to an inflow end of the rotor flow path.

3. The compressor of claim 2, wherein the first space is located above the electric motor, the second space is located below the electric motor to form an oil reservoir in which oil is stored, an outer peripheral surface of the stator has a groove through which the first and second spaces communicate with each other, the first opening opens to the first space, and the second opening opens to the second space.

* * * * *